US006758361B2

(12) United States Patent
Hunt

(10) Patent No.: US 6,758,361 B2
(45) Date of Patent: Jul. 6, 2004

(54) RELOCATABLE STORAGE TANKS FOR LIQUIDS AND GRANULAR MATERIALS

(75) Inventor: Rowland D. Hunt, Santa Barbara, CA (US)

(73) Assignee: Chinook Concepts Inc., Santa Barbara, CA (US)

( * ) Notice: Subject to any disclaimer, the term of this patent is extended or adjusted under 35 U.S.C. 154(b) by 0 days.

(21) Appl. No.: 10/245,631

(22) Filed: Sep. 17, 2002

(65) Prior Publication Data

US 2003/0062290 A1 Apr. 3, 2003

Related U.S. Application Data

(60) Provisional application No. 60/325,461, filed on Sep. 28, 2001.

(51) Int. Cl.[7] ..... B65D 90/02

(52) U.S. Cl. ..... 220/565; 220/4.12; 220/4.16; 206/527

(58) Field of Search ..... 206/386, 599, 206/600, 527; 220/4.29, 9.1–9.4, 4.12, 4.13, 4.16, 565; 383/104, 119

(56) References Cited

U.S. PATENT DOCUMENTS 2,378,126 A * 6/1945 Blair ..... 220/565
2,969,102 A * 1/1961 Cunningham ..... 220/565
3,372,855 A * 3/1968 Smith ..... 206/386
3,595,291 A * 7/1971 Grunhoff et al. ..... 220/565
4,421,253 A 12/1983 Croley
4,516,692 A 5/1985 Croley
5,025,925 A * 6/1991 Wiklund ..... 206/386
5,069,359 A 12/1991 Liebel
D334,238 S 3/1993 Spedini
5,782,360 A * 7/1998 Markson ..... 206/600
6,000,549 A * 12/1999 Perkins ..... 206/600
6,113,270 A * 9/2000 Hafer ..... 383/119
6,164,453 A 12/2000 Perkins

* cited by examiner

*Primary Examiner*—Luan K. Bui
(74) *Attorney, Agent, or Firm*—McGinn & Gibb, PLLC; Mohammad S. Rahman

(57) ABSTRACT

A relocatable storage tank for flowable materials such as liquids and granular materials comprises a bag of flexible material and has a generally square, rectangular, or circular shape, resting on a solid surface, together with at least one central post which supports the upper portion of the bag, wherein the post aids in carrying the weight of the flowable materials to the ground, thereby reducing the associated mechanical tensions in the fabric of the flexible material.

22 Claims, 8 Drawing Sheets

RELOCATABLE STORAGE TANKS FOR LIQUIDS AND GRANULAR MATERIALS

CROSS-REFERENCE TO RELATED APPLICATION

This application claims the benefit of U.S. Provisional Patent Application No. 60/325,461 filed Sep. 28, 2001.

BACKGROUND OF THE INVENTION

1. Field of the Invention

The present invention generally relates to flexible storage tanks, and more particularly to a flexible relocatable storage tank for flowable materials such as liquids and granular material.

2. Description of the Related Art

Conventional structures for relocatable and collapsible tanks utilize designs such as a pillow or bladder tank, available from Aero Tec Laboratories, Inc., N.J., U.S.A. and others, which consists of a bag made in the shape of a pillowcase using flexible material. When empty, the bag folds flat and may be rolled or folded for storage and shipment. The filling/discharge flange is integrated into the top panel of the material, and the storage volume is sealed at all times with a negligible air or vapor pocket. This conventional design is a formless package when folded for transport with no real strong confluence points to allow for lifting to load onto a transport. In larger sizes, it must be loaded onto a single stiff pallet to allow for lifting by a forklift or crane. One of the other drawbacks of this conventional design is that the pillow tank does not tolerate high site slopes, and requires relatively large site areas because the average depth of the stored liquid inside of the tank is low. Moreover, such tanks appear to be relatively expensive, and do not lend themselves to the storage of granular materials. Also, liquids stored in the pillow tanks, which are exposed to bright sunlight, get extremely hot. This is undesirable for fuels or potable water. In order to ameliorate this effect, a cover needs to protect the tank from the sun, which requires a considerable structure to span the overall exposed surface of the tank.

Another conventional design uses rigid tanks, which are built with rigid panels forming the sides, and often a rigid metal support frame. The loads imposed by the stored liquid or grain are carried directly by these panels. These tanks may have a plastic membrane liner; however, this is not structural, rather it is provided more for sealing purposes only. Such tanks usually require prepared unsloped sites.

Other conventional designs consist of flexible bags with an external frame, such as the type disclosed in U.S. Pat. No. D334,238 and issued to Spedini, further illustrated in FIG. 1 herein. These designs are used especially for above-ground swimming pools, and consist of a tank using a bag of strong flexible material supported by an external metal frame consisting of a rim in the horizontal plane, supported off the ground by a series of inclined metal posts. As shown in FIG. 1, the flexible bag is a structural member which carries the loads imposed by the weight of the peripheral liquid or grain to the rim of the tank, and hence to the ground via the supporting posts. The weight of the liquid/grain in the central area of the tank, where the fabric is in contact with the ground, is supported directly by the ground. This conventional design offers a highly portable, low weight tank, which can be quickly and easily installed and dismantled. However it suffers from the following disadvantages.

First, the external structure of the conventional fabric tank must be considerably over-designed for the chosen depth of the associated liquid/grain because for depths differing from the design depth, the rim and external posts of the tank are subjected to extra bending loads, as depicted in the illustration of the conventional design used in practice shown in FIG. 2. This is particularly critical for the posts, which are subjected to significant compression forces, because the applied bending significantly increases the tendency for the posts to buckle. A second disadvantage of the conventional design shown in FIGS. 1 and 2 is that for similar reasons related to the varying depths of the associated liquid/grain, the problem is exacerbated if the tank is to be used in an emergency or unprepared, sloping, or undulating ground. Typically, these conventional tanks are severely limited to a few degrees of slope. Thus, such designs with external frames are used primarily for aboveground swimming pools, where the water is typically at or close to design depth, and such designs have found no functional application in storage tanks, which of course, must accommodate a large range of depths.

Moreover, the conventional fabric tank designs use relatively light fabrics for the bag and several light rigid components for the external frame. However, it is really only suitable for applications which can accept an open liquid surface, thereby limiting its use to non-potable water. Moreover, these conventional designs do not easily accept other granular materials, nor do they tolerate more than minimal slopes, and the frame must be stiffened appreciably to cope with partially filled conditions.

Therefore, there is a need for a relocatable storage tank for flowable materials such as liquids and granular materials comprising a bag of flexible material and having a generally square, rectangular, or circular shape, resting on a solid surface, together with at least one central post which supports the upper portion of the bag, wherein the post aids in carrying the weight of the flowable materials to the ground, thereby reducing the associated mechanical tensions in the fabric of the flexible material. Moreover, there is a need for a larger flexible relocatable storage tank for flowable materials such as liquids and granular materials which can improve the ease of relocation of the stored materials, and which allows for the use of the storage tank in confined and sloping sites, especially for temporary and/or emergency situations.

SUMMARY OF THE INVENTION

In view of the foregoing and other problems, disadvantages, and drawbacks of the conventional storage tanks the present invention has been devised, and it is an object of the present invention to provide a structure for a relocatable storage tank for liquids and granular materials. It is another object of the present invention to provide a structure for a relocatable storage tank for liquids and granular materials which improves the ease of relocation of the tank, and to allow use of the tank in confined and on sloping sites, especially for temporary and emergency conditions. It is a further object of the present invention to allow for larger depths of storage for the stored liquids in the storage tank. Still another object of the present invention is to allow for filling, storage, and discharge of granular materials from the storage tank. Yet another object of the present invention is to collect and carry the peripheral liquid/granular loads in tension, and take these loads to the ground in compression in at least one internal support system.

In order to attain the objects suggested above, there is provided, according to one aspect of the invention, a storage tank for flowable material such as liquids and granular material, wherein the storage tank comprises a container of flexible material, wherein the flexible material comprises a base portion for engaging a supporting surface, and at least one supporting post system mounted over the base portion and supported by the supporting surface, wherein the flexible material extending upwardly from the base portion forms a side portion and an upper portion of the storage tank, and is secured to the supporting post system. Furthermore, the storage tank of the present invention is provided in multi-geometrical embodiments including generally square, rectangle, circular, and polygonal shapes. In an alternative embodiment, the storage tank comprises an upper cap positioned on the upper portion of the storage tank. In another alternative embodiment, the storage tank further comprises support cables attaching the supporting post system to the supporting surface.

Additionally, the supporting post is generally rigid. Also, in an alternative embodiment, the supporting post is generally solid. Alternatively, the supporting post is generally hollow. Also, the supporting post may be embodied as a float. In another embodiment, the at least one supporting post system comprises a plurality of supporting posts interconnected by a linking element. Still alternatively, the storage tank comprises an outer support fabric over the flexible material. Additionally, the storage tank may further comprise a covering sheet over the storage tank, embodied as a fly sheet for solar protection and slope stabilization. The fly sheet could also provide a cover from rain, snow, leaves, etc.

In an alternative embodiment, a storage tank for flowable material such as liquids and granular material comprises a container of flexible material, wherein the flexible material comprises a base portion for engaging a supporting surface, and at least one support system positioned over the base portion, wherein the flexible material extends upwardly from the base portion to form a side portion of the storage tank, and is secured to one of a support rim and the support system, wherein the support rim is positioned over the base portion. The support system comprises one of a post and a float. Moreover, the post may be either solid or hollow. In an alternative embodiment, the storage tank further comprises a plurality of cables attaching the support rim to the support system. Furthermore, in another embodiment, the at least one support system comprises a plurality of supports interconnected by a linking element. Alternatively, the storage tank comprises an outer support fabric over the flexible material. Additionally, the storage tank may further comprise a covering sheet over the storage tank, embodied as a fly sheet for solar protection and slope stabilization.

In another alternative embodiment, the present invention provides a storage tank for flowable material such as liquids and granular material, wherein the storage tank comprises a flexible bag having a side portion and an upper portion. The storage tank further comprises at least one support structure contained within the flexible bag, whereby the support structure is positioned below the upper portion of the flexible bag, wherein the flexible bag is secured to a supporting surface, and wherein the support structure is secured to the supporting surface. Additionally, the flexible bag extends upwardly from the supporting surface, and is secured to one of a support rim and the support structure, wherein the support rim is positioned below the upper portion of the flexible bag. Alternatively, the storage tank further comprises a plurality of cables attaching the support rim to the support structure. The support structure may be embodied as a post, which may be hollow or solid, or the support structure may be embodied as a float. Still alternatively, the at least one support structure comprises a plurality of supports interconnected by a linking element. In another embodiment, the storage tank further comprises an outer support fabric over the flexible material. Additionally, the storage tank may further comprise a covering sheet over the storage tank, embodied as a fly sheet for solar protection and slope stabilization.

The present invention overcomes the several disadvantages of the conventional designs. For example, the present invention provides for an essentially vertical storage of the tank when it is not in use (i.e., stored footprint is very small), without requiring accessory equipment. Also, the present invention is easily loadable and carried to site by a forklift, crane, etc., without requiring accessory lifting gear such as pallets or a carrying case. The present invention tolerates installation and filling on sloping sites. Moreover, on steep slopes (approximately 10 degree grade), the present invention can easily be made stable by utilizing simple guy ropes/cables attached to the central post and anchored to the high side of the site. Additionally, the present invention's central post provides a support for a fly sheet for solar heating and UV protection at a low cost. In fact, it is feasible to use this fly sheet to create some shrapnel protection for military use.

Other advantages of the present invention are that the present design allows for larger depths of stored liquids than conventional flexible tanks, and hence smaller footprint areas for a given capacity, which is ideal at congested or restricted sites. Furthermore, the present design accommodates for filling, storage, and discharge of granular materials at lower production costs compared to traditional designs.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF PREFERRED EMBODIMENTS OF THE INVENTION

Figure 1:
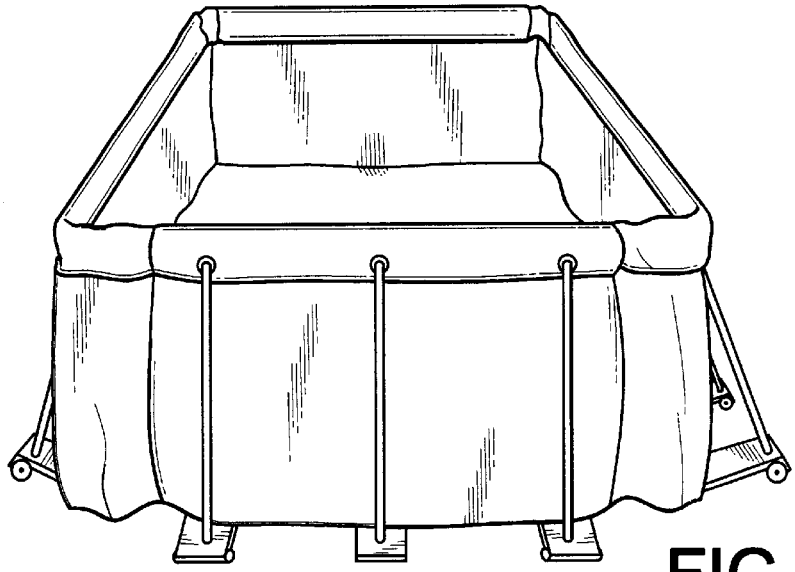
FIG.1 PRIOR ART
FIG. 1 is a schematic diagram of a conventional fabric tank design.
Figure 2:
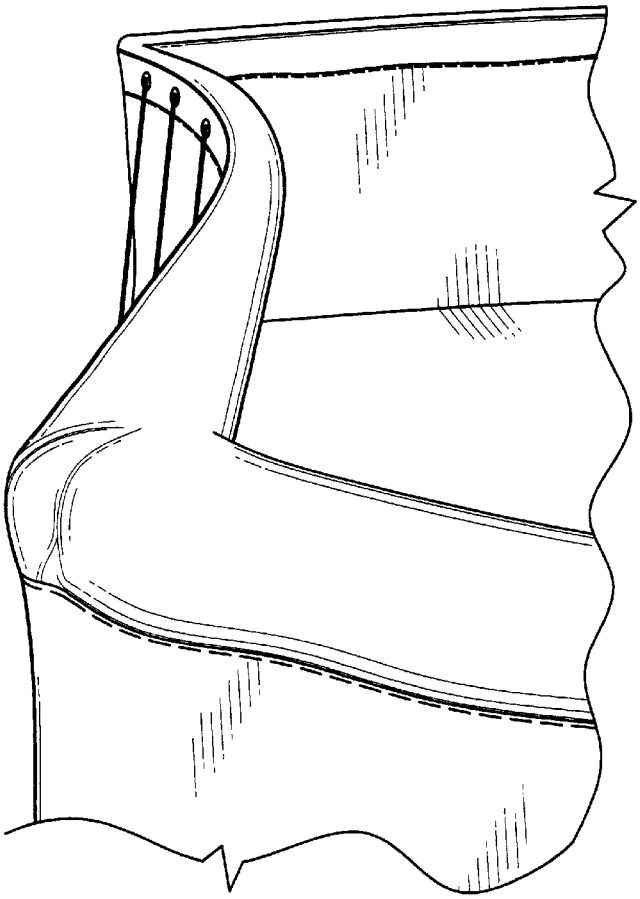
FIG.2 PRIOR ART
FIG. 2 is a schematic diagram of a conventional fabric tank design.

As previously mentioned, there is a need for a novel relocatable storage tank for liquids and granular materials. The present invention provides a relocatable storage tank, which may be easily stored, transported, and assembled if necessary, on unprepared and/or sloping sites. The present invention provides a flexible storage tank capable of taking some of the weight of the stored liquid or grain down to the ground through a support system, embodied as vertical post(s), thereby relieving the flexible bag of some of the weight, which in turn, allows for reduced mechanical tensions in the bag.

Referring now to the drawings, and more particularly to FIGS. 3 through 10, there are shown preferred embodiments of the structures according to the present invention. Specifically, FIG. 3A illustrates a storage tank 1 positioned on a level planar supporting surface 2. The storage tank 1 comprises a container 3 of flexible material 4 for storing internal contents such as liquids and granular materials 19 at varying design depths 9. The container 3 further comprises a base portion 5 for engaging the supporting surface 2. Moreover, the container 3 further comprises at least one supporting system (support structure) 6 preferably embodied as a post 6 mounted over the base portion 5 and is supported by the supporting surface 2. The flexible material 4 extends upwardly from the base portion 5 to form the sides 8 and the upper portion 17 of the tank 1, and is secured to the supporting post 6 at the upper portion 17 of the container 3.

Figure 3A:
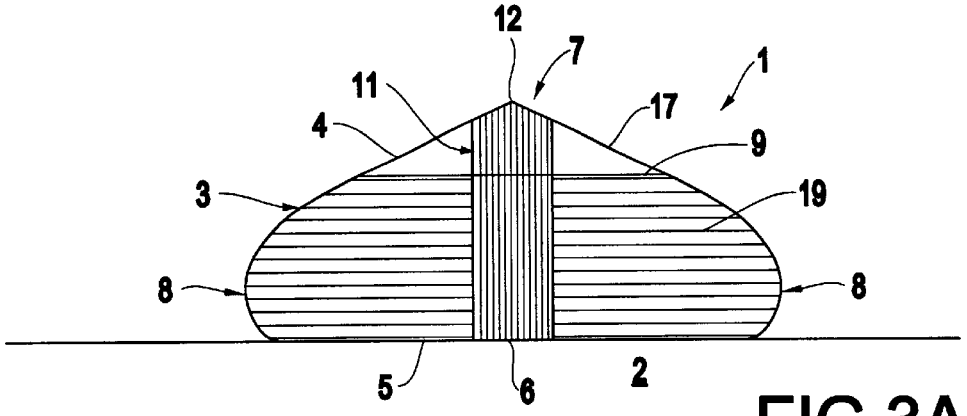
FIG. 3A is a schematic diagram of a storage tank according to the present invention.

The internal frame support system 11 of the tank 1 comprises the at least one column or post 6, placed inside the suitably shaped flexible bag 4. In this design, all of the peripheral liquid/granular loads are carried up the fabric sides 8 to the top 7 of the central post 6. FIG. 3A shows the storage tank 1 on a zero degree grade flat site 2, whereby all of the horizontal components of the loads are balanced, and the only load to be carried by the post 6 is a vertical compression load, which the generally large-diameter single post 6 can easily withstand without buckling.

The angle of the top or "roof" 17 (the angle of the roof is that portion above the waterline 9 to the top 7 of the post 6) of the tank 1 may be selected, preferably at any angle less than approximately 80 degrees, but for acceptable post heights, it is best selected no greater than approximately 45 degrees from the horizontal. The shape of the curved side 8 of the fabric bag 4 is best calculated for the chosen roof angle at the design depth 9, when the fabric tensions are highest. For two dimensional balance, the curve 8 is established by making the local radius of curvature of the bag 3 at each liquid (or granular material) depth 9 according to the formula $R=K(T/H)$, where R is the local radius of curvature, T is the fabric tension, H is the local depth of the stored material, and K is a constant and depends on the density of the stored material. From the design level 9 to the top 7 of the post(s) 6, the bag 3 is generally straight.

The bag 3 may distort somewhat from this datum shape on sloping sites, and when the tank is less than full, but this is accommodated by the flexible fabric 4, and the tensions do not increase significantly beyond the design datum.

Figure 3B:
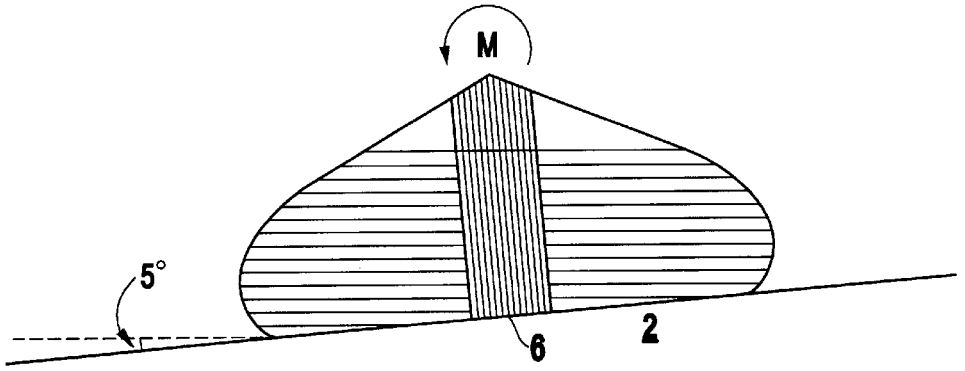
FIG. 3B is a schematic diagram of the storage tank of FIG. 3A on a sloped surface according to the present invention.
Figure 3C:
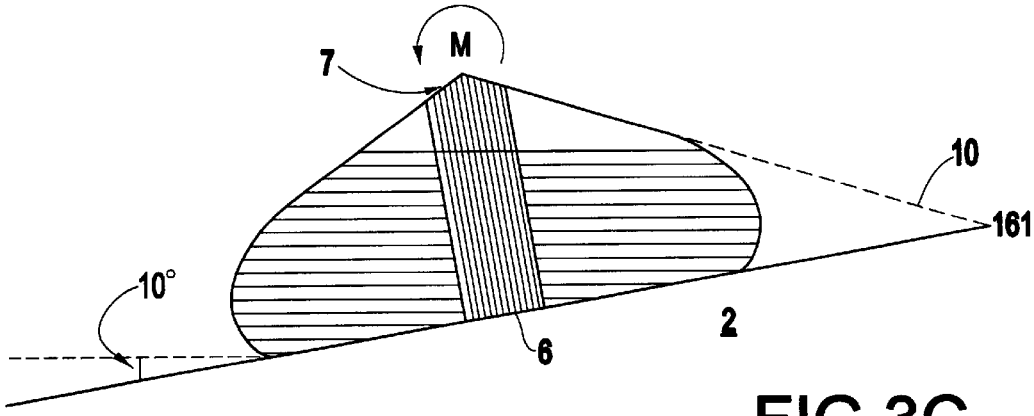
FIG. 3C is a schematic diagram of the storage tank of FIG. 3A on a sloped surface according to the present invention.

If the site 2 is sloping or undulating, as indicated by the five degree slope in FIG. 3B, the horizontal loads will not be completely in balance, resulting in an overturning and bending moment M in the central post 6. For effective site slopes up to approximately 10 degrees, as indicated in FIG. 3C, this overturning and bending moment M can easily be carried by the generally short, large diameter column 6 without overturning or buckling. Furthermore, for such steep site slopes, a smaller diameter central column 6 may be used and be relieved of some or all of this overturning and bending moment M by attaching support cables 10, such as guy wires/cables 10 to the support post system 6, and preferably at the top 7 of the column 6, and anchoring the wires 10 to the ground 2 on the upper sides(s) 161 of the site 2.

This present design with an internal frame 11 makes it feasible to use existing fabrics 4 for water depths 9 up to approximately 10 feet, and grain depths 9 up to approximately 20 feet, with adequate factors of safety on fabric strength, for a large variety of square, rectangular, polygonal, and circular tank shapes.

Figure 4A:
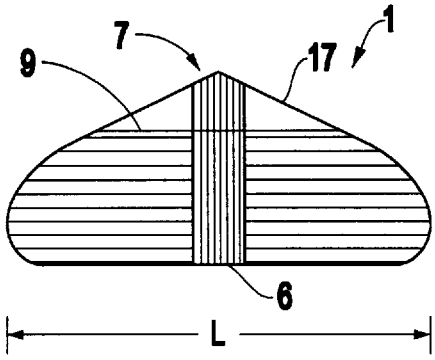
FIG. 4A is a schematic diagram of an alternative embodiment of a storage tank according to the present invention.
Figure 4B:
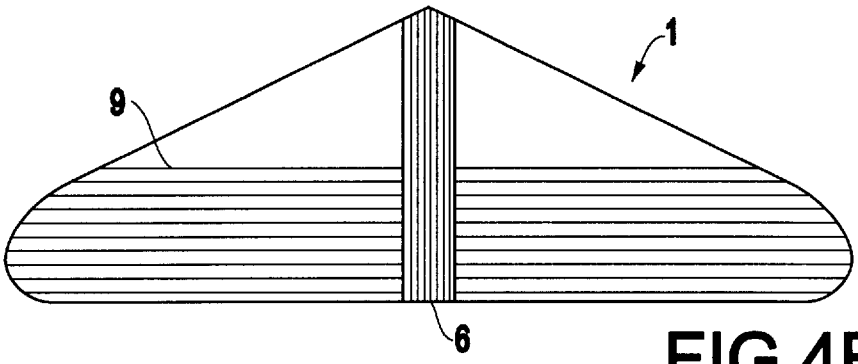
FIG. 4B is a schematic diagram of an alternative embodiment of the storage tank of FIG. 4A according to the present invention.
Figure 4C:
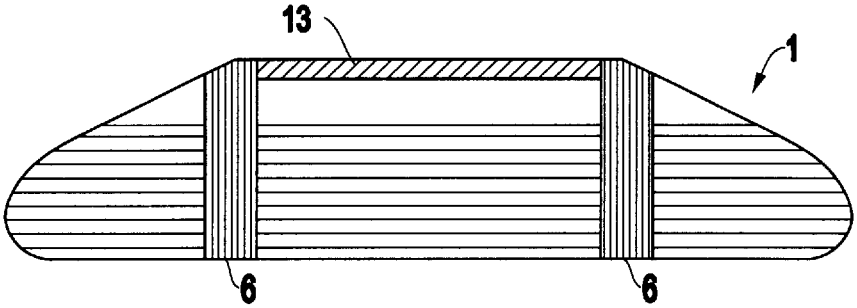
FIG. 4C is a schematic diagram of an alternative embodiment of the storage tank of FIG. 4A according to the present invention.
Figure 4D:
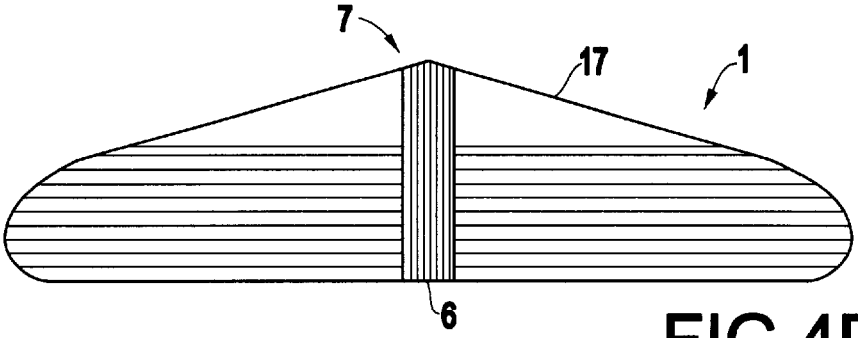
FIG. 4D is a schematic diagram of an alternative embodiment of the storage tank of FIG. 4A according to the present invention.

The entry/exit locations 12 for the stored material 9 may be within the post(s) 6 themselves, or in the fabric bag 4. The concept allows for virtually any shape/configuration of the tank 1. For example, FIG. 4A shows the geometry for a "square" tank 1 with a liquid depth 9 one-third of the overall length L of the tank 1, and a sloped top or roof 17 to shed rain and snow. The length L is the overall length of the tank 1 when filled. This is within a few % of the length of the tank 1 when empty. The length L of this configuration may be increased without increasing the liquid depth 9, as shown in FIG. 4B. If eventually the central post 6 becomes unacceptably high, then multiple posts 6 can be used, and interconnected together with a linking element 13, as shown in FIG. 4C. Alternatively, the slope of the roof 17 may be increased/decreased as shown in FIG. 4D, depending on the rate of rain and snow to be shed, or the granular material to be stored. Preferably, for granular material storage, the design is best arranged with a roof angle steeper than its angle of repose.

In an identical fashion, the width of the tank may also be increased, giving rise to multiple configurations shown in FIGS. 5A through 5K. It should be appreciated by those skilled in the art, that other configurations not specifically illustrated herein, may be used within the context of this invention.

Figure 6:
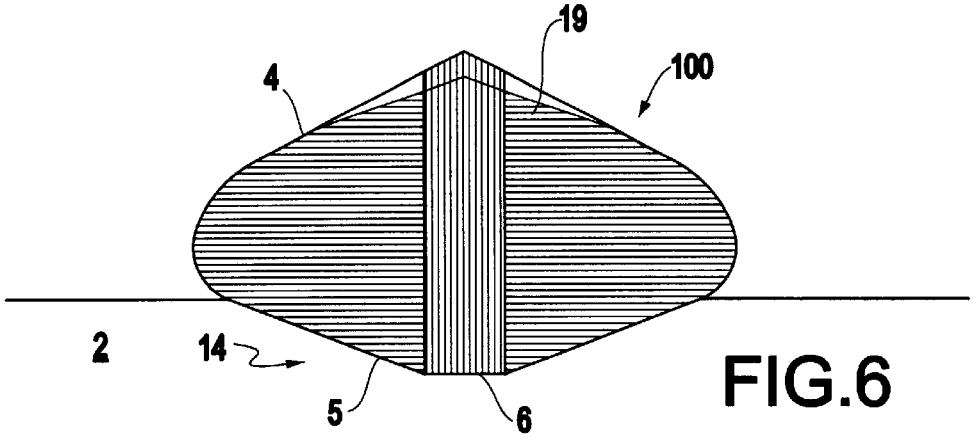
FIG. 6 is a schematic diagram of an alternative embodiment of a storage tank according to the present invention.
Figure 10A:
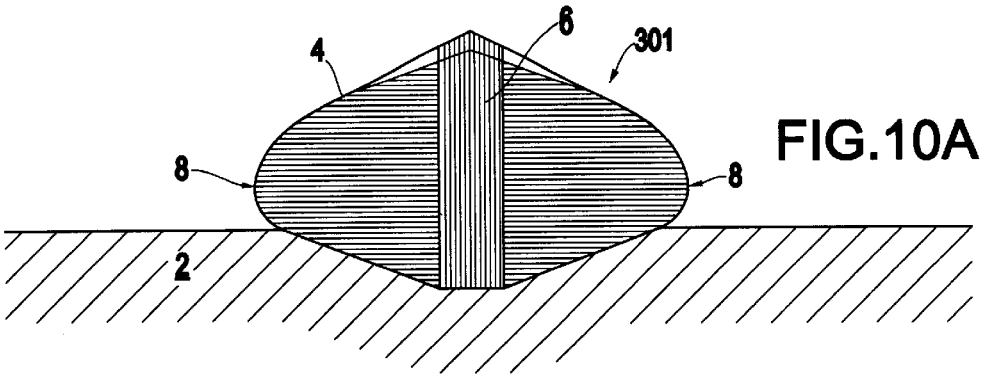
FIG. 10A is a schematic diagram of an alternative embodiment of a storage tank according to the present invention.
Figure 10B:
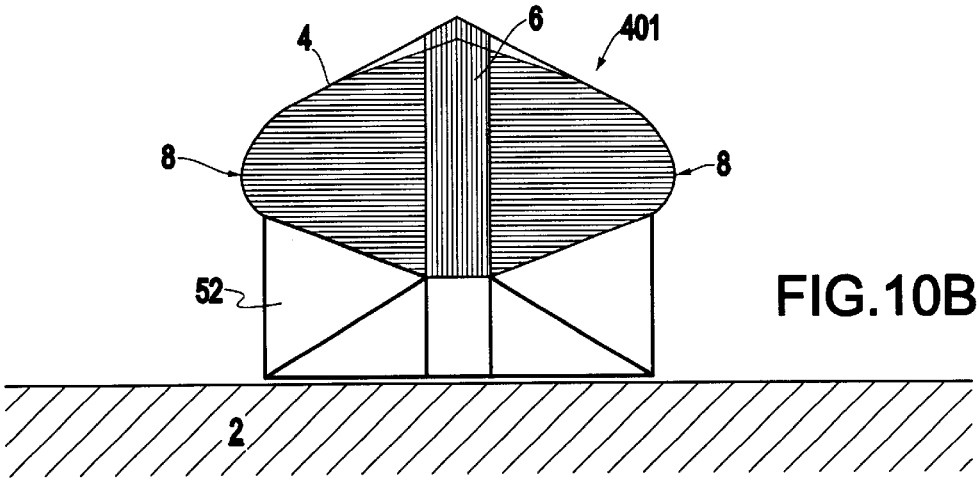
FIG. 10B is a schematic diagram of an alternative embodiment of a storage tank according to the present invention.

For non-emergency situations, where it is feasible and economical to create a depression 14 in the ground 2 below the tank 100, the fabric bag 4 can be shaped whereby the base portion 5 of the storage tank 100 fits into this depression 14, as is depicted in FIG. 6. This allows practically all of the stored liquid to be drawn off, and all of the stored granular material 19 to be easily discharged (by auger or by suction) as long as the depression angle is greater than the angle of repose. Alternatively, an inverted conical or pyramidal depression may be formed by an elevated rigid platform 52, to allow for unloading of the container by gravity as seen in FIG. 10B.

Figure 7:
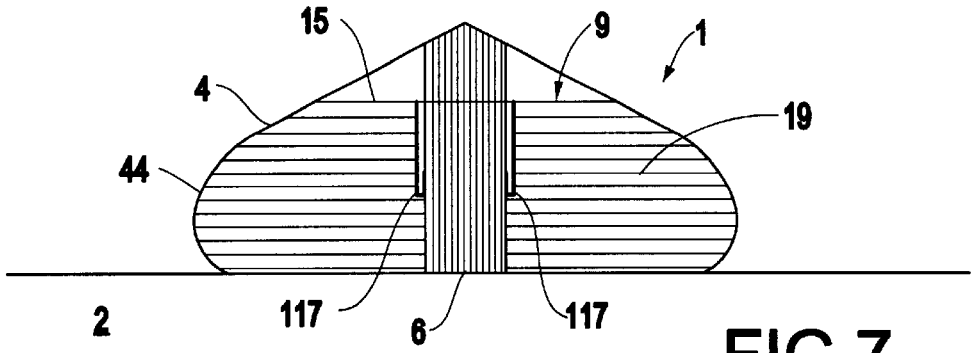
FIG. 7 is a schematic diagram of an alternative embodiment of a storage tank according to the present invention.

Next, as illustrated in FIG. 7, if necessary, to reduce the non-divisible weight for installation or transportation, or to carry higher tensions from increases in stored depth 9, the fabric bag 4 can comprise a load-carrying outer support fabric 44 and an inside non-load-carrying plastic liner 15 for sealing the liquids or grains 19. The outer support fabric 44, which is positioned over the flexible material 4, may comprise, for example, a polymer coating on a woven base or scrim cloth. The inner plastic liner 15 may comprise, for example, a single film of polymer, which could expand with the water depth 9. This solution may be particularly useful for military purposes, where the tank 1 could be shipped with several different plastic liners 15, to be chosen or rotated at the site to allow for storage of fuel, potable water, etc. It could also be useful to form a completely sealed storage volume 117, which needs no venting.

Figure 8:
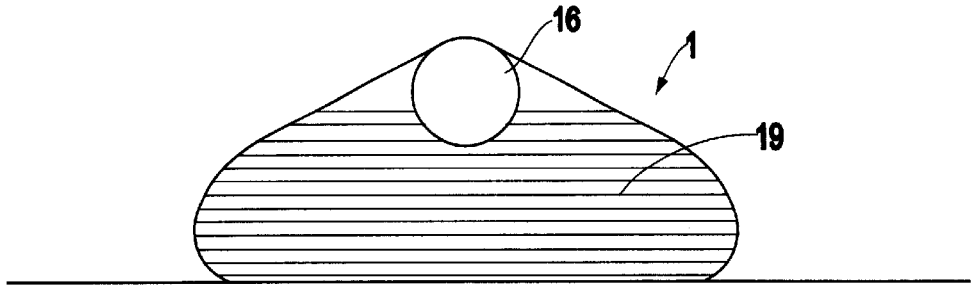
FIG. 8 is a schematic diagram of an alternative embodiment of a storage tank according to the present invention.
Figure 9A:
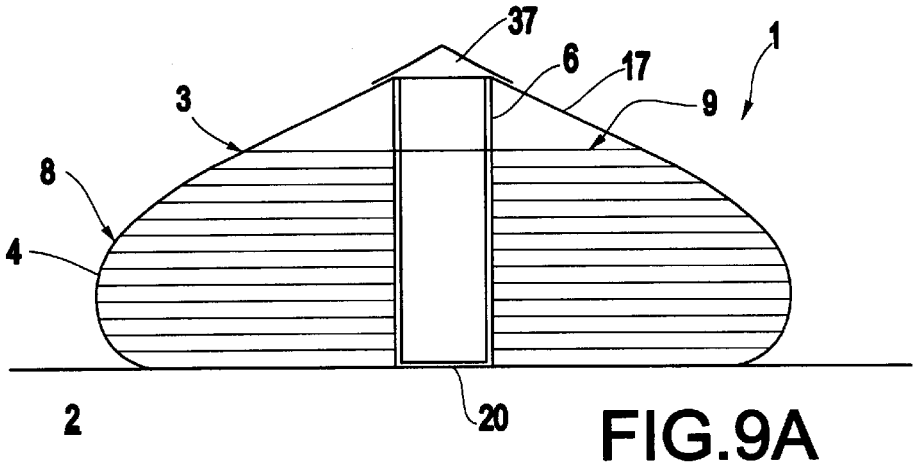
FIG. 9A is a schematic diagram of an alternative embodiment of a storage tank according to the present invention.
Figure 9B:
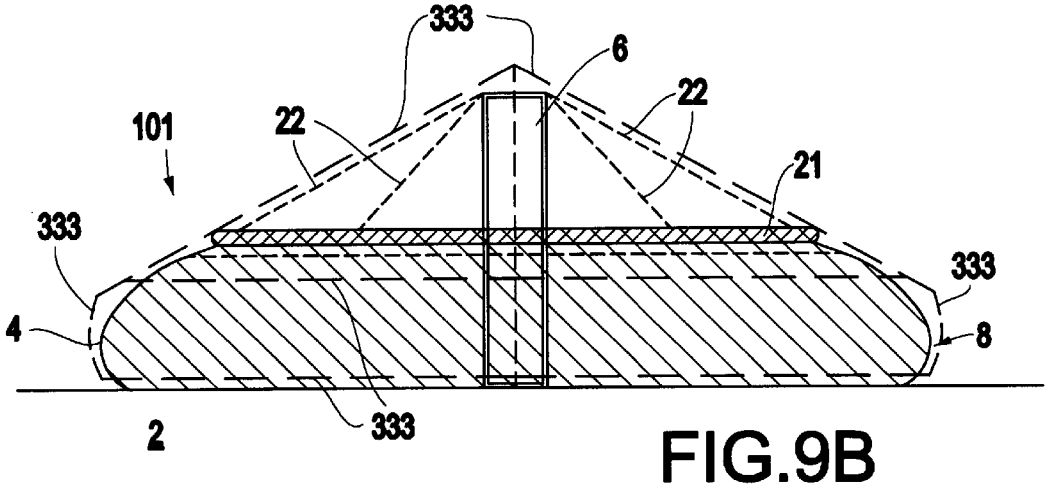
FIG. 9B is a schematic diagram of an alternative embodiment of a storage tank according to the present invention.

In all or most of the configurations described above, the required vertical loads could alternatively be provided by pressurized buoyancy bag(s) 16 floating on the liquid/grains 19 acting as the support system, as shown in FIG. 8, instead of by rigid post(s). FIG. 9A shows the geometry for a storage tank 1 with a fixed bottom cap 20 and a removable top cap 37. The upper cap 37 is positioned on the upper portion 17 of the storage tank 1. The fabric 4 may be constructed using, for example, a 22 oz/sq.yd. high strength PVC/polyester fabric. It may be folded and placed inside the hollow supporting post system (cylinder) 6 for transportation and storage. The diameter of cylinder 6 is sufficient to stabilize the tank 1 when fully or partially filled 9, even on site slopes of 8 to 10 degrees. The fabric bag 4 of the container 3 can either be carried all the way to the central post 6, as indicated in FIG. 9A, or may be terminated just above the waterline 9 in a metal rim 21, as shown in FIG. 9B, while straps or cables 22 carry the fabric loads to the central post 6.

The present invention may be practiced in several alternative embodiments depending on the application of use. For example, the traditional use is to utilize a square planform tank 1 with a single vertical post 6, as illustrated in FIG. 4A. In emergency fire fighting or fish farming use, the open tank 101 design of the present invention is most suitable, which requires taking the fabric loads to a stiff metal support rim 21, and carrying those loads to the support system (post) 6 by cables or straps 22 as shown in FIG. 9B. For potable water uses, the top 17 of the storage tank 1 should be sealed, which is best performed by continuing the fabric 4 directly to the support system (post) 6, either in a stronger fabric 4 at the top 7 or by reinforcing straps (not shown) welded to the fabric.

Figure 9C:
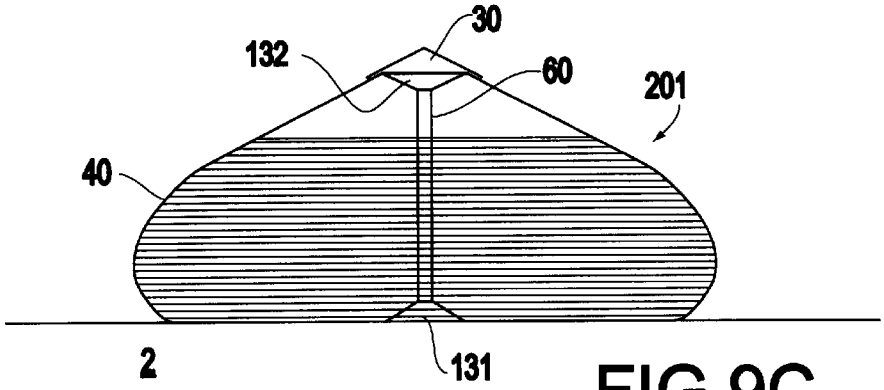
FIG. 9C is a schematic diagram of an alternative embodiment of a storage tank according to the present invention.

The preferred post configuration for non-potable water is to make the post 6 as a hollow canister (cylinder) large enough to contain the fabric bag 4 when it is folded. This means that the bag 4 can itself be stored in the rigid canister 6 when the tank 1 is not in use, protected from UV and dust, and storage and handling damage. The footprint of the canister 6 is generally small which is important for storage and shipment in readiness for emergency applications. For potable water tanks 201, as shown in FIG. 9C, the post 60 is made with a generally small diameter (with a generally wider base 131 and top 132), and the fabric bag 40 is folded up on the outside of the narrow post 60. An upper cap 30 may also be provided. This configuration does not provide the bag storage protection, which the canister design provides. However, it avoids any possible contamination, which might otherwise be caused by inserting the canister 6 into the bag 4 on site.

Figure 5A:
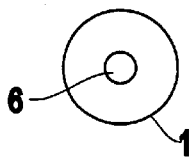
FIG. 5A is a top view of a storage tank configuration according to the present invention.
Figure 5B:
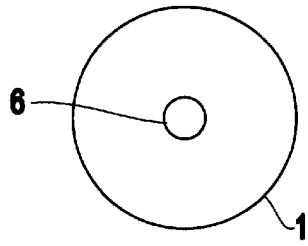
FIG. 5B is a top view of an alternative storage tank configuration according to the present invention.
Figure 5C:
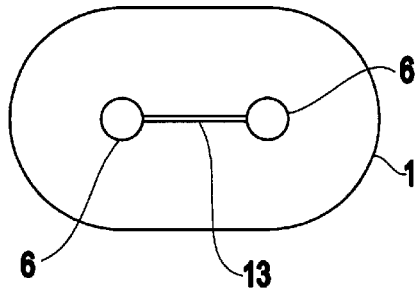
FIG. 5C is a top view of an alternative storage tank configuration according to the present invention.
Figure 5D:
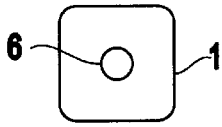
FIG. 5D is a top view of an alternative storage tank configuration according to the present invention.
Figure 5E:
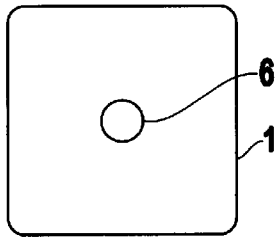
FIG. 5E is a top view of an alternative storage tank configuration according to the present invention.
Figure 5F:
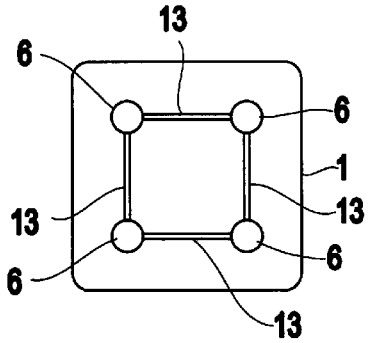
FIG. 5F is a top view of an alternative storage tank configuration according to the present invention.
Figure 5G:
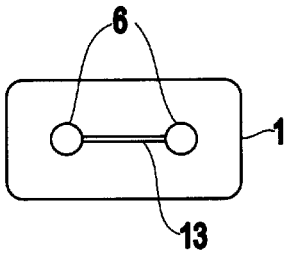
FIG. 5G is a top view of an alternative storage tank configuration according to the present invention.
Figure 5H:
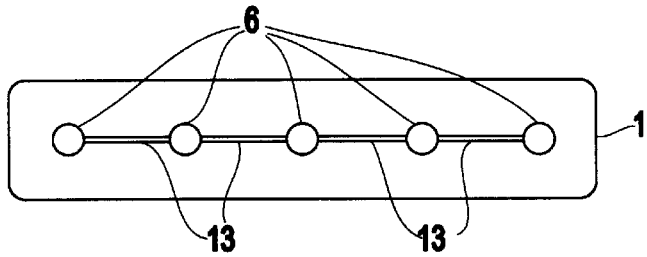
FIG. 5H is a top view of an alternative storage tank configuration according to the present invention.
Figure 5I:
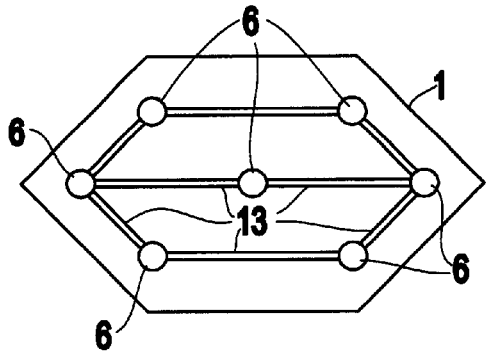
FIG. 5I is a top view of an alternative storage tank configuration according to the present invention.
Figure 5J:
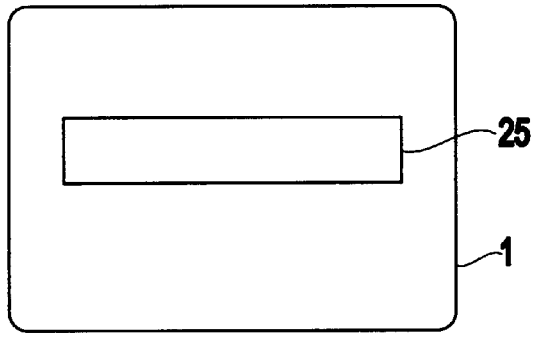
FIG. 5J is a top view of an alternative storage tank configuration according to the present invention.
Figure 5K:
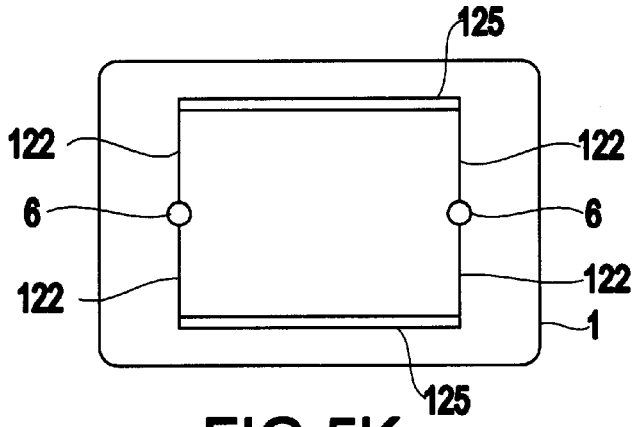
FIG. 5K is a top view of an alternative storage tank configuration according to the present invention.
Figure 10C:
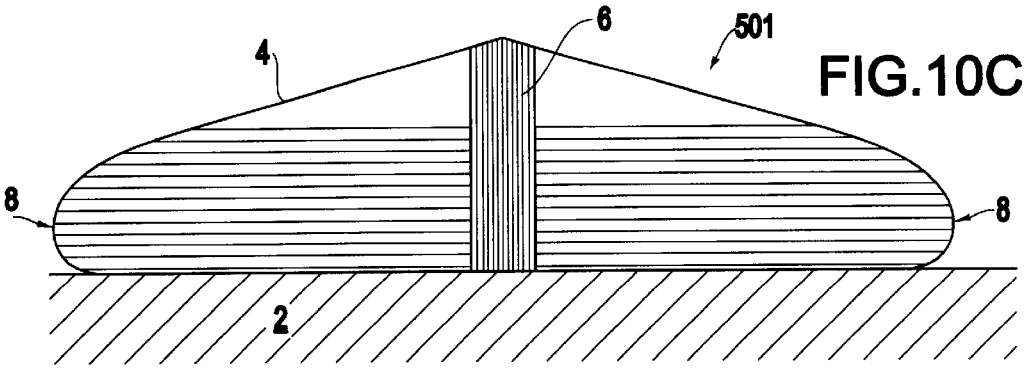
FIG. 10C is a schematic diagram of an alternative embodiment of a storage tank according to the present invention.

Some of the alternative embodiments of the present invention include using multi-shaped tanks with multiple posts, such as those described in FIGS. 5A through 5K. Other embodiments include having the bags 4 shaped to fit a level, conical, or V-shaped site 2, or to be mounted on the surface of a raised platform 52 with a rigid surface providing the bottom to the tank 301, 401, 501 as shown in FIGS. 10A through 10C, respectively. Alternatively, a substitute buoyant sphere 16 for generally square-shaped tanks 1, as seen in FIG. 8, or a buoyant tube 25 positioned along the centerline of a generally rectangular tank 1, may be used instead of the post(s) 6, as shown in FIG. 5J. Still alternatively, for generally larger tanks, use of a structural outer bag 14, which may be a woven mesh or net to carry the loads and a thinner non-porous liner 15 to seal the liquid may be incorporated. Moreover, the loads generally increase near the support posts 6. In order to carry increased tensions, several alternatives exist. First, heavier fabrics 4 may be used near the upper portion 17 of the storage tank 1. Second, welded on webbing straps 10, 22 may be used. Third, rim tubes 125 may be used to collect the loads and distribute them to the top 7 of the posts 6 by cables or straps 122 (see FIG. 5K). Fourth, catenary cables (not shown) may be used.

In the alternative embodiments described above, and as illustrated in FIGS. 10A through 10C, the fabric bag 4 and support structure 6 are attached directly to the supporting surface (ground 2 as seen in FIGS. 10A and 10C, or a raised platform 52, such as the bed of a transportation vehicle as seen in FIG. 10B) thereby avoiding the necessity of having a fabric base portion 5 as required by the embodiments illustrated in FIG. 3A and FIG. 6. In FIG. 10A, the storage tank 1 comprises a flexible bag 4 having a side portion 8 and an upper portion 17; and at least one support structure 6 contained within the flexible bag 4, wherein the support structure 6 is positioned below the upper portion 17 of the flexible bag 4, wherein the flexible bag 4 is secured to a supporting surface 2, and wherein the support structure 6 is secured to supporting surface 2.

The present invention overcomes the several disadvantages of the conventional designs. For example, the present invention provides for an essentially vertical storage of the tank when it is not in use, without requiring accessory equipment (i.e., stored footprint is very small). Also, the present invention is easily loadable and carried to site by a forklift, crane, etc., without requiring accessory lifting gear such as pallets or a carrying case. The present invention tolerates installation and filling on sloping sites. Moreover, on steep slopes (approximately 10 degree grade), the present invention can easily be made stable by utilizing simple guy ropes/cables 10 attached to the central post 6 and anchored to the high side 161 of the site 2. Additionally, the present invention's central post 6 provides a support for an optional coversheet 333 over the storage tank, embodied as a fly sheet 333 for solar heating and UV protection as well as slope stabilization at a low cost, as seen in FIG. 9B. In fact, it is feasible to use this fly sheet 333 to create some shrapnel protection for military use. The fly sheet 333 could also provide a cover from rain, snow, leaves, etc.

Other advantages of the present invention are that the present design allows for larger depths of stored liquids than conventional flexible tanks, and hence smaller footprint areas for a given capacity, which is ideal at congested or restricted sites. Furthermore, the present designs accommodate for filling, storage, and discharge of granular materials at lower production costs compared to traditional designs.

While the invention has been described in terms of preferred embodiments, those skilled in the art will recognize that the invention can be practiced with modification within the spirit and scope of the appended claims.

What is claimed is:

1. A closed storage tank for flowable material such as liquids and granular material, said storage tank consisting of:

a container of flexible material, wherein said flexible material comprising a substantially square base portion for engaging a supporting surface; and a single non-buckling supporting post within said container and mounted over a substantially central portion of said base portion and supported by said supporting surface, wherein said flexible material extending upwardly from said base portion forms a side portion and a sloped upper portion opposite said base portion of said storage tank, and being secured to a top portion of said supporting post, and wherein a vertical load carried by said supporting post is a compression load.

2. The storage tank of claim 1, wherein said storage tank comprises an upper cap positioned on said upper portion of said storage tank.

3. The storage tank of claim 1, further comprising support cables attaching said supporting post to said supporting surface.

4. The storage tank of claim 1, wherein said supporting post is hollow.

5. The storage tank of claim 1, further comprising an entry/exit opening in said sloped upper portion.

6. The storage tank of claim 1, further comprising an outer support fabric over said flexible material.

7. The storage tank of claim 1, further comprising a covering sheet over said storage tank.

8. The storage tank of claim 1, further comprising an entry/exit opening within said supporting post.

9. A partially-closed storage tank for flowable material such as liquids and granular material, said storage tank consisting of:

a container of flexible material, wherein said flexible material comprises a substantially square base portion for engaging a supporting surface; and a single non-buckling support post within said container and positioned over a substantially central portion of said base portion, wherein said flexible material extends upwardly from said base portion to form a side portion and a sloped upper portion opposite said base portion of said storage tank, and is secured to a support rim of said support post, wherein said support rim is positioned over said base portion, and wherein a vertical load carried by said support post is a compression load.

10. The storage tank of claim 9, further comprising a plurality of cables attaching said support rim to said support post.

11. The storage tank of claim 9, wherein said support post is a hollow post.

12. The storage tank of claim 9, further comprising an entry/exit opening in said sloped upper portion.

13. The storage tank of claim 9, further comprising an outer support fabric over said flexible material.

14. The storage tank of claim 9, further comprising a covering sheet over said storage tank.

15. A closed storage tank for flowable material such as liquids and granular material, said storage tank consisting of:

a flexible bag having a side portion and a sloped upper portion; and a single non-buckling support post structure contained within said flexible bag, said support structure positioned below a substantially central portion of said upper portion of said flexible bag, wherein a vertical load carried by said support post structure is a compression load, wherein said flexible bag is secured to a supporting surface opposite said upper portion, and wherein said support structure is secured to said supporting surface.

16. The storage tank of claim 15, wherein said flexible bag extends upwardly from said supporting surface, and is secured to one of a support rim and said support post structure, wherein said support rim is positioned below said upper portion of said flexible bag.

17. The storage tank of claim 16, further comprising a plurality of cables attaching said support rim to said support post structure.

18. The storage tank of claim 15, wherein said support post structure is a hollow post.

19. The storage tank of claim 15, further comprising an entry/exit opening within said support post structure.

20. The storage tank of claim 15, further comprising an entry/exit opening in said sloped upper portion.

21. The storage tank of claim 15, further comprising an outer support fabric over said flexible material.

22. The storage tank of claim 15, further comprising a covering sheet over said storage tank.

* * * * *